United States Patent [19]

Jahnke

[11] Patent Number: 4,734,653

[45] Date of Patent: Mar. 29, 1988

[54] MAGNETIC FIELD APPARATUS FOR A PARTICLE ACCELERATOR HAVING A SUPPLEMENTAL WINDING WITH A HOLLOW GROOVE STRUCTURE

[75] Inventor: Andreas Jahnke, Forchheim, Fed. Rep. of Germany

[73] Assignee: Siemens Aktiengesellschaft, Munich, Fed. Rep. of Germany

[21] Appl. No.: 826,111

[22] Filed: Feb. 5, 1986

[30] Foreign Application Priority Data

Feb. 25, 1985 [DE] Fed. Rep. of Germany ..... 3506562

[51] Int. Cl.[4] ..... H01J 23/10

[52] U.S. Cl. ..... 328/233; 313/153; 328/235

[58] Field of Search ..... 328/228, 233, 234, 235; 313/361.1, 153, 154, 156, 62

[56] References Cited

U.S. PATENT DOCUMENTS

| | | | |
|---|---|---|---|
| 2,898,456 | 8/1959 | Christofilos | 328/233 |
| 3,005,954 | 10/1961 | Heard | 313/359.1 |
| 3,324,325 | 6/1967 | Briggs | 313/62 |
| 3,344,357 | 9/1967 | Blewett | 328/233 |
| 3,506,865 | 4/1970 | Briggs | 328/233 |

OTHER PUBLICATIONS

IEEE Trans. on Nuclear Sci., vol. NS-30, No. 4, Aug. 1983, pp. 2531-2533.

Nuclear Instruments and Methods 204 (1982) pp. 1-20, 177 (1980) pp. 411-416, 203 (1982) pp. 1-5.

*Primary Examiner*—David K. Moore

*Assistant Examiner*—K. Wieder

*Attorney, Agent, or Firm*—Kenyon & Kenyon

[57] ABSTRACT

A magnetic field apparatus for a particle accelerator having a particle track having curved sections contains several magnetic field-generating windings, and at least one supplemental winding provided for focusing the electrically charged particles. The system does not require pre-accelerators and relatively large particle streams should be capable of being accelerated nevertheless to relatively high energy levels. In the region of at least one of the curved sections of the particle track, an azimuthal guiding field for the particles is generated by the supplemental winding during the acceleration phase. This supplemental winding is designed as an appropriately curved electric conductor arrangement which in part encloses the particle track and which is designed in the manner of a hollow channel open toward the outside. The conductor arrangement is appropriately structured for suppressing eddy currents and carries a current transversely to the particle track.

8 Claims, 2 Drawing Figures

MAGNETIC FIELD APPARATUS FOR A PARTICLE ACCELERATOR HAVING A SUPPLEMENTAL WINDING WITH A HOLLOW GROOVE STRUCTURE

BACKGROUND OF THE INVENTION

The present invention relates to magnetic-field apparatus for a particle accelerator, the particle track of which has at least curved sections, with several magnetic field-generating windings, wherein at least one supplemental winding for focusing the electrically charged particles is provided. Such apparatus is known, for instance, from the publication "Nuclear Instruments and Methods", vol. 203, 1982, pages 1 to 5.

With known, smaller electron accelerators of circular shape which are also called "microtrons", particle energies up to about 100 MeV can be achieved. These systems can be realized particularly also as so-called "race track" microtrons. The particle tracks of this type of accelerator are composed of two semi-circles each having one 180° deflection magnet and further having two straight track sections (see "Nucl. Instr. and Meth.", vol 177, 1980, pages 411 to 416, or vol. 204, 1982, pages 1 to 20).

If the desired final energy of the electrons is to be increased from 100 MeV to, for instance, 700 MeV, increasing the magnetic field is available, with no change in the dimensions. Such magnetic fields can be generated particularly with superconducting magnets.

If, however, low-energy electrons are injected into a microtron, which in addition, can further comprise superconducting magnet windings with a very low magnetic field, a number of possible field error sources must be noted in order to keep the electron losses during the acceleration phase low. For example, at the beginning of this phase, the field level for electrons injected at a low energy of, for instance, 100 keV, is only about 2.2 mT with a radius of curvature of the accelerator of, for instance, 0.5 m. However, with such low magnetic field intensities or with high field-change rates, the danger then exists that, due to field-distorting interference sources, the field error limits which are to be kept, may be exceeded. In order to be able to guide an electron beam through weak focusing, a field accuracy $\Delta B/B_0$ of about $10^{-3}$ would be required; this means that the field at the beginning of the acceleration phase must be adjustable to an accuracy of about 0.002 mT. Then, however, the cause of undesired field distortion can be external fields such as the Earth's field with 0.06 mT, or the field of magnetizable, i.e., para-, ferrior ferro magnetic parts of a magnet system. Also, eddy currents in metallic parts of the magnet itself or in its conductors can lead to corresponding disturbances. In addition, shielding currents in the conductors of a superconducting winding or so-called frozen magnetic fluxes in these conductors can constitute such error sources.

It has been attempted to eliminate difficulties resulting from such interference field sources, for instance, by shielding or compensation of the interfering field. Thus, it is attempted in known electron accelerators with normal-conducting copper coils to obtain a shielding effect by means of a flux return of iron. In addition, laminating the iron yokes of the field-generating magnets is known for suppressing the formation of eddy currents. Possibly, a field reversal can also be performed in order to traverse the hysteresis curve of the iron of the magnetic apparatus reproducibly.

A further difficulty arises if relatively large particle streams are to be produced and the particles are to be injected into the accelerator track with relatively low energy. This is because the repulsion forces acting between the individual particles (space charge forces) are relatively dominant; i.e., the particle stream attempts to diverge to a corresponding degree. One is therefore compelled to provide additional measures for focusing the particle beam. In the electron accelerator known from the literature reference mentioned above, "Nucl. Instr. and Meth.", the 180°-deflection magnets with a main winding generating a dipole field also comprise a supplemental winding focusing the particles onto the particle track. In addition, a focusing solenoid system is provided in the region of the straight track sections. In the known magnetic apparatus, however, the deflection magnets enclose the respective curved section of the particle track so that the synchrotron radiation occurring there cannot be utilized.

Because of the interference effects on low-energy particle beams occurring especially if superconducting deflection magnets are used, the particles are generally injected only at higher field level, i.e., with higher energy, since then the mentioned interference effects are only of smaller or secondary importance. Such a mode of operation of the accelerators necessitates appropriate pre-accelerators and is therefore accordingly expensive.

SUMMARY OF THE INVENTION

It is therefore an object of the present invention to develop the magnetic-field apparatus of an accelerator mentioned above such that relatively large streams of charged particles can be accelerated with it to relatively high energy levels, for instance, to several hundred MeV in the case of electrons, without the need for separate pre-accelerators.

The above and other objects of the invention are achieved by the provision that an azimuthal guiding field for the particles can be generated during the acceleration phase by the supplemental winding in the region of at least one of the curved sections of the particle track if the winding comprises an appropriately curved electric-conductor arrangement which partly encloses the particle track, and further comprises a hollow channel open toward the outside and structured for suppressing eddy currents, and through which a current flows transversely to the particle track.

Due to this design of the magnetic apparatus, also super-conducting deflection magnets for fields between about 2 mT and 100 mT can advantageously be utilized for the acceleration of, especially, electrons, by generating an azimuthal component of the field guiding the particles. Because of the hollow-channel-like design of the conductor arrangement serving this purpose, the emission of synchrotron radiation laterally outward is not impeded. With this conductor arrangement, which additionally can be carried out in a manner known per se, eddy currents excited therein by the magnet winding are effectively suppressed.

BRIEF DESCRIPTION OF THE DRAWINGS

The invention will be explained in greater detail in the following detailed description, with reference to the drawings, in which.

DETAILED DESCRIPTION

Figure 1:
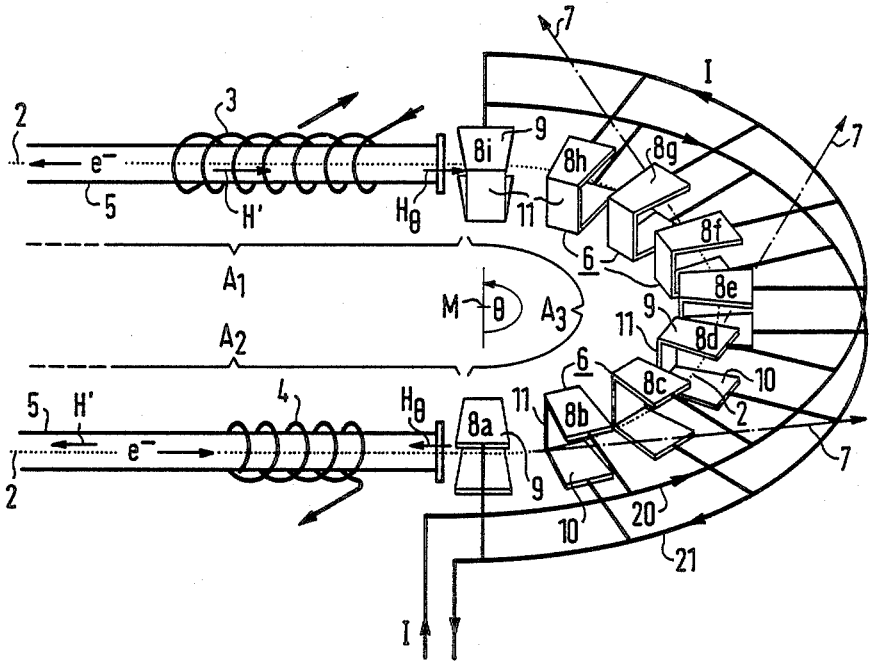
FIG. 1 shows a magnetic field apparatus according to the invention schematically.

With reference now to the drawings, from the perspective view of FIG. 1, the conductor arrangement of a magnetic field apparatus according to the invention can be seen. This apparatus is to be provided particularly for electron accelerators of the race track type ("race track microtrons") known per se. The dipole deflection magnets required for this purpose are bent here in the shape of semicircles in accordance with the curved particle track (see, for instance, "IEEE Trans. Nucl. Sci.", vol. NS-30, no. 4, August 1983, pages 2531 to 2533). Since particularly end energies of the particles of several hundred MeV are desired, the windings of the magnets are then preferably made of superconductive material because of the high field intensities required.

With the design of the magnetic field apparatus according to the invention, it should be possible to assure a circular azimuthal component of the magnetic field with an at the same time unimpeded discharge of the synchrotron radiation. Due to such a component, additional focusing of the electron beam during the still low-energy acceleration phase can be achieved also if superconducting deflection magnets are used. Then, electrons with a relatively low injection energy of, for instance, several hundred keV and relatively high particle density, for instance, a pulse current of, for instance, at least 20 mA with pulse lengths in the microsecond range can be injected directly into the particle track; i.e., preaccelerators for injecting electrons with higher energy can then advantageously be dispensed with. The superconducting deflection magnets can therefore also be utilized for fields between about 2 mT and 100 mT for the acceleration of the electrons. The conductor arrangement required for this purpose for generating the appropriate azimuthal component of the induction $B_\theta$ or the magnetic field $H_\theta$ in the region of a deflection magnet as well as of the magnetic field component H' in the straight regions of the particle track is shown in detail in FIG. 1. $\theta$ is here the azimuthal angle of the particle track of the electrons $e^-$ which is indicated in the figure by a dotted line and is designated with 2.

This conductor arrangement is therefore provided along the entire revolution of the electrons $e^-$. The magnetic field component H' in the straight track sections $A_1$ and $A_2$ is generated by two solenoid coils 3 and 4 which surround an electron beam chamber 5 which contains the electrons $e^-$ and is not further detailed in the figure. Such solenoids are employed, for instance, in heavy-current betatrons for focusing beams (see "IEEE Trans. Nucl. Sci." vol. NS-30, no. 4, August 1983, pages 3162 to 3164). In the vicinity $A_3$ of the superconducting 180° deflection coils, which are not shown in the figure and generally have dipole windings, an electrical conductor arrangement 6 is provided according to the invention which partly surrounds the semicircular electron track and is curved accordingly. This conductor arrangement is designed in the shape of a hollow channel, i.e., it is open toward the outside so that the synchrotron radiation illustrated by lines 7 with arrows can get to the outside unimpeded. The conductor arrangement 6 should additionally be structured so that eddy currents generated therein by the windings of the respective deflection magnet are suppressed effectively. According to the embodiment shown in the figure, the conductor arrangement 6 is therefore composed of a multiplicity of individual elements 8*a* to 8*i* which are lined up one behind the other in the direction of the beam guidance. Each of these, for instance, nine elements, is approximately U-shaped as seen in a section transversely to the direction of the beam guidance, in that it comprises an approximately rectangular or circular-ring sector-shaped upper part 9 and the corresponding lower part 10 which are connected to each other by a lateral part 11. The parts 9 and 10 are located here in parallel planes above and below the particle track 2, with the lateral parts 11 arranged on the inside of this particle track. In order to generate the required additional azimuthal magnetic field $H_\theta$, all elements 8*a* to 8*i* are connected to each other electrically and carry a current I in the current flow direction indicated by arrows in the figure, transversely to the particle track and in the circumferential direction around the particle stream.

The conductor arrangement 6 therefore constitutes a slotted quasi solenoid with at least one turn which should be arranged within a 180°-deflection magnet. Normal-conducting as well as superconductive conductor material can be chosen here for the conductor arrangement 6. The former can thus, of course, have an accordingly different shape in the form of hollow channels or tubes slotted on the outside in the direction of the particle guidance, deviating from the embodiment shown in FIG. 1. Thus, also circular or oval cross section shapes are suitable for the conductor arrangement. A hollow-channel like construction of an electrically non-conducting material is also conceivable, which serves as the carrier body for the individual conductor runs of the condutor arrangement. In some cases, this carrier body can even be the beam guiding chamber itself.

In addition, the lateral parts 11 of the elements 8*a* to 8*i* also need not extend in the immediate proximity of the particle track 2. These parts 11 can rather be located also near the center M of the respective 180° deflection magnet, where the upper and lower parts 9 and 10 must be arranged at a correspondingly larger distance with respect to the particle track 2.

In the embodiment shown in FIG. 1, it was further assumed that all elements 8*a* to 8*i* are connected electrically in parallel only via two lead conductors 20 and 21 directly to each other. These current leads are arranged so that they do not impede the discharge of the synchrotron radiation 7. Optionally, however, the elements 8*a* to 8*i* can also form several partial groups, to which respectively current leads of their own lead. The conductor arrangement 6 would then represent a solenoid with an appropriate number of turns.

In the magnetic field apparatus designed in accordance with the invention, a $B_\theta$ component of about 20 mT is additionally switched on for guiding the beam after the injection of electrons, for instance, with an injection energy of 100 keV. For this field, a number of ampere turns of about 25 kA through the U-shaped conductor elements 8*a* to 8*i* is needed. In contrast to the design of the conductor arrangement 6 having at least one conductor turn, the straight solenoid coils 3 and 4 can be laid out with many turns and are then operated with correspondingly smaller current.

Figure 2:
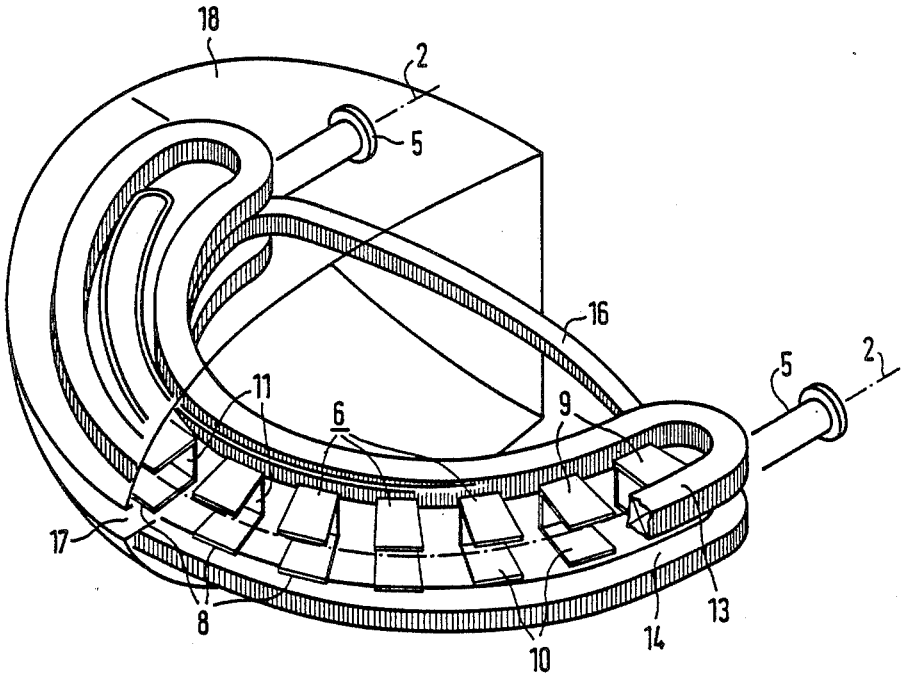
FIG. 2 shows such a magnetic-field apparatus as part of an electron accelerator. Like parts are provided in the figures with like reference symbols.

In FIG. 2, a curved 180°-dipole magnet of an electron accelerator is shown schematically in a partly broken-away view. This magnet comprises two large curved dipole windings 13 and 14 which are arranged on both sides of an electron beam chamber 17 surrounding the particle track 2, lying in parallel planes. Along the curved inside of the magnet of the electron beam chamber 17, there is an additional gradient winding 16. Since the conductors of these windings 13, 14 and 16 consist of superconductive material, these windings are contained in a housing 18 which contains cryogenic coolant required for cooling the superconductors. The electron beam chamber to which the beam guiding tube 5 is flanged in the transition region between straight and curved sections of the particle track, is designed between the windings as a U-shaped beam chamber 17 open toward the outside so that the synchrotron radiation can be brought out. The chamber 17 is connected to the housing 18, and both parts thus represent a closed container for the coolant. As can further be seen from the side elevation of the figure, the electron beam chamber 17 is surrounded from the inside by the hollow-channel-like conductor arrangement 6 which is formed by individual elements 8, i.e., the chamber serves as a support body for the element 8.

The azimuthal guiding field which can be generated with the design of the magnetic field apparatus according to the invention is effective substantially with weak fields and high field change rates. With higher fields (B greater than 1 T) and smaller field change rates B, such a guiding field is largely superfluous since the main windings of the magnetic-field-generating apparatus can then take over the guidance of the particles in the known matter.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A magnetic field apparatus for an electrically charged particle accelerator having a particle track, the particle track including at least one curved section having a plurality of magnetic-field-generating windings, and wherein at least one supplemental winding for focusing the electrically charged particles is provided, the supplemental winding comprising means for generating an azimuthal guding field for the particles during acceleration of the particles in a region of the at least one curved section of the particle track, said supplemental winding comprising a curved electrical conductor arrangement which has a curvature adapted to the curvature of the curved section of the particle track and which partly encloses the particle track, said electrical conductor arrangement having a curved hollow groove structure which is slotted on the outside thereby allowing emission of synchrotron radiation laterally outwardly, and further including means for suppressing eddy currents, said conductor arrangement carrying a current transverse to the particle track.

2. The magnetic field apparatus for a particle accelerator recited in claim 1 wherein the particle track has a straight section, further comprising means disposed in the region of the straight section of the particle track for generating an azimuthal guiding field for the particles during acceleration.

3. The magnetic field apparatus recited in claim 2, wherein the means for generatign the azimuthal guiding field in the region of the straight section comprises a solenoid winding.

4. The magnetic field apparatus recited in claim 1, wherein at least one of the magnetic-field generating windings and the conductor arrangement comprise, at least partially, superconducting conductors.

5. The magnetic field apparatus recited in claim 1 wherein the conductor arrangement comprises a plurality of individual U-shaped elements arranged transversely to the particle track.

6. The magnetic field apparatus recited in claim 5, wherein the individual U-shaped elements are connected electrically in parallel to each other by means of at least one pair of current leads.

7. The magnetic field apparatus recited in claim 1 wherein the conductor arrangement is arranged on an appropriately designed support body of electrically insulating material.

8. The magnetic field apparatus recited in claim 1, wherein the electrically charged particles to be accelerated comprise electrons.

* * * * *